United States Patent [19]

Ahmed et al.

[11] Patent Number: 4,867,899

[45] Date of Patent: Sep. 19, 1989

[54] SODIUM MONOGLYCERIDE SULFATE DETERGENT COMPOSITION BAR AND PROCESS FOR MANUFACTURE THEREOF

[75] Inventors: Fahim U. Ahmed, Dayton, N.J.; Thomas J. Gabor, Forest Hills, N.Y.; Ernest G. Muller, Piscataway; Ravi Subramanyam, Perth Amboy, both of N.J.

[73] Assignee: Colgate-Palmolive Company, Piscataway, N.J.

[21] Appl. No.: 126,433

[22] Filed: Nov. 30, 1987

[51] Int. Cl.[4] ..... C11D 9/32; C11D 15/04

[52] U.S. Cl. ..... 252/121; 252/367; 252/368; 252/369; 252/370; 252/DIG. 16

[58] Field of Search ..... 252/121, DIG. 16, 367, 252/368, 369, 370

[56] References Cited

U.S. PATENT DOCUMENTS

| | | | |
|---|---|---|---|
| 3,030,310 | 4/1962 | Turck, Jr. | 252/121 |
| 3,186,948 | 6/1965 | Sweeney | 252/161 |
| 3,224,976 | 12/1965 | Farrar et al. | 252/119 |
| 3,694,367 | 9/1972 | Peters et al. | 252/121 |
| 3,708,425 | 1/1973 | Compa et al. | 252/89 |
| 4,543,204 | 9/1985 | Gervasio | 252/531 |
| 4,584,126 | 4/1986 | Joshi | 252/368 |

FOREIGN PATENT DOCUMENTS 723925 2/1955 United Kingdom .

*Primary Examiner*—A. Lionel Clingman

*Attorney, Agent, or Firm*—Richard J. Ancel; Robert C. Sullivan; Murray M. Grill

[57] ABSTRACT

Detergent bars, intended for personal use, which are of good foaming, lather, solubility, wear, slough, hardness, mildness (to the skin) and tactile characteristics, and which are homogeneous so that users of such bars will detect no surface grittiness on washing with them, even in cold water, include in the composition thereof, water soluble higher fatty monoglyceride sulfate, water soluble higher fatty acid soap and higher fatty acid, preferably of certain types and in certain proportions. Such bars may be made by a manufacturing process, in a step of which the higher fatty acid soap and higher fatty acid are dissolved in an aqueous lower alcoholic extractant solution of the water soluble higher fatty monoglyceride sulfate. Also within the invention is such a process for manufacturing such detergent composition bars, in which the extractant solution of the monoglyceride sulfate, preferably in aqueous isopropanol, is employed to dissolve kettle soap and higher fatty acids, after which the solution is quick-dried, as in a film dryer, preferably of the wiped film type, and is processed to bar form in usual manner.

15 Claims, 1 Drawing Sheet

SODIUM MONOGLYCERIDE SULFATE DETERGENT COMPOSITION BAR AND PROCESS FOR MANUFACTURE THEREOF

This application relates to monoglyceride sulfate detergent composition bars and processes for manufacturing such products. More specifically, it relates to such bars which are of good foaming, lather, solubility, wear, slough, hardness, mildness (to the skin), tactile and homogeneity characteristics, and especially to those of such improved homogeneity that surface grittiness does not develop on washing with them, even in cold water. In the described process aspect of the invention the main components of the detergent composition are dissolved in an aqueous organic solvent, which is quick dried to make a homogeneous detergent composition "chip" or solid, which is then processed to bar and cake forms.

PRIOR ART

Monoglyceride sulfate detergents are known in the art and have been incorporated in cleaning products that have been marketed in the United States and other countries. A very popular shampoo, HALO®, marketed by the assignee of the present application, was based on the ammonium salt of coco monoglyceride sulfuric acid. Such assignee has also marketed a synthetic detergent bar that is sold under the trademark VEL®, which consists essentially of sodium coco monoglyceride sulfate, and a combination soap-synthetic detergent bar, CHARMIS®, which was primarily comprised of soap, with a minor proportion of sodium coco monoglyceride sulfate. However, so far as is known, before the present invention synthetic detergent composition bars comprising monoglyceride sulfate, soap and higher fatty acid were never marketed, in which the synthetic organic detergent component was present in major proportion or in which it was present in a proportion greater than that of the soap and higher fatty acid constituents. The bars of the present invention have properties different from those of VEL and CHARMIS, and present different problems to formulators and processors.

A search conducted to locate relevant prior art resulted in the findings of U.S. Pat. Nos. 2,678,921; 2,868,731; 2,894,912; 3,226,330; 3,376,229; and 3,879,309. also considered to be relevant is Japanese patent application No. 137208/78. U.S. Pat. No. 2,678,921 describes monoglyceride sulfate detergent bars which may contain a very small proportion of soap (Example IV). The patent also mentions the employment of plasticizers, such as lower alkylene glycol esters of higher fatty acids, and teaches the incorporation of water insoluble soap in bar formulations. U.S. Pat. No. 2,868,731, a process patent, describes the mixing of water soluble soap, anionic and/or nonionic synthetic organic detergent(s) and aliphatic higher carboxylic acid with a limited proportion of water, heating such mixture and plodding to bar form. U.S. Pat. No. 2,894,912 (a DOVE® patent) relates to isethionate detergent bars, which can contain soaps and free fatty acids, (Example V) and may also comprise other detergents and plasticizers. However, the other detergents listed in the patent do not include monoglyceride sulfates. U.S. Pat. No. 3,226,330 describes a soap-synthetic detergent combination bar comprising monoglyceride sulfate, sodium salt of higher acyl amide of N-methyl taurine, a major proportion of sodium soap, starch and moisture, with a limited content of inorganic salts. U.S. Pat. No. 3,376,229 is for an isethionic acid ester detergent bar containing water soluble higher fatty acid soap and higher fatty acid. The presence of up to bout 17% of unesterified water soluble alkali metal isethionates in the bar results in improved firmness and improved ploddability and processing characteristics. U.S. Pat. No. 3,879,309 describes detergent bars based on mixtures of acyl isethionates of selected critical chain lengths, which are said to exhibit superior lathering properties. Such bars include sodium soap, higher fatty acid, sodium isethionate and other synthetic organic detergents, but do not include monoglyceride sulfate detergent. Japanese patent application No. 137208/78 describes detergent bars which contain a major proportion of monoglyceride sulfate detergent and which may include various adjuvants. However, the only such adjuvants described are water, titanium dioxide, cetyl alcohol and sugar wax. The bars made are said to be mild to the skin and are said to soften less when soaked in soft water, than do bars made of beef tallow-coconut oil soap or N-acylamino acid salt (Table 2).

The above analyses of the search materials and commercial products indicate that the subject matter of this invention is novel, and it is considered to be unobvious, in both its composition and process aspects.

BRIEF DESCRIPTION OF THE DRAWING

The manufacturing, extraction and processing to final detergent bar form of this invention will be readily understood by reference to the accompanying drawing, in which.

Figure 1:
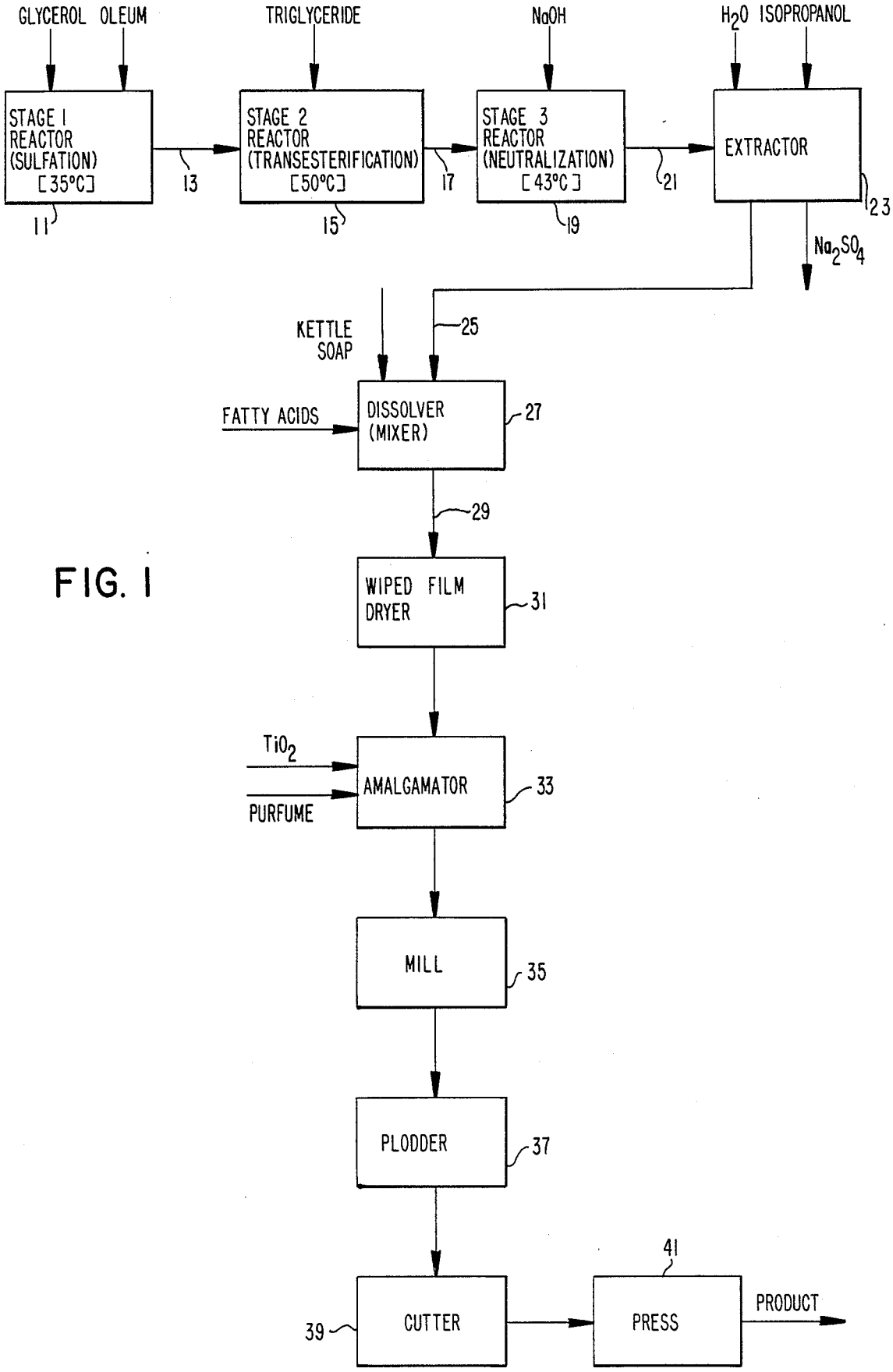
FIG. 1 is a schematic diagram or flow sheet illustrating such processes.

In the drawing Stage 1 reactor 11 is the situs for sulfation of glycerol by oleum at a temperature of about 35° C. The glycerol trisulfuric acid resulting is fed via line 13 to Stage 2 reactor 15 wherein the glycerol trisulfuric acid is transesterified with triglyceride, at a temperature of about 50° C., producing monoesterified glycerol disulfuric acid (the so-called acid mix), which passes through line 17 to Stage 3 reactor 19. In such reactor the glycerol disulfuric acid monoester is neutralized with sodium hydroxide solution, producing sodium monoglyceride sulfate, accompanied by sodium sulfate byproduct and ether soluble organic matter (impurities), which includes unreacted glycerol, unreacted diglyceride, and fatty acid hydrolysis products of the triglyceride. Such materials are fed through line 21 to extractor 23, to which water and isopropanol are added. In the extractor the contents separate into two phases, with the lower aqueous phase containing most of the sodium sulfate dissolved therein and the upper aqueous alcoholic phase containing the monoglyceride sulfate and the lipophiles or ether solubles (which are also soluble in aqueous isopropanol), with some sodium sulfate. The upper phase solvent medium is about a 1:1 cosolvent solution of isopropanol and water but such ratio may be in the range of 2:1 to 1:2, preferably 3:2 to 2:3. After removal of the aqueous sodium sulfate phase the remaining aqueous isopropanol phase, containing the monoglyceride sulfate, is passed through line 25 to dissolver (mixer) 27, to which kettle soap, in liquid state at elevated temperature, and fatty acids (which may be in solid state) are added. Alternatively, the fatty acid may be emulsified or dissolved first in the hot kettle soap and the emulsion or solution may then be dissolved in the aqueous isopropanol extractant medium, which also contains the monoglcyeride sulfate. The temperature in the dissolver will normally be in the range of about 50° to 90° C., e.g., about 60° C., and the various components will be perfectly dissolved in each other and in the aqueous isopropanol medium, with the total solids content normally being in the range of 45 to 65%, e.g., about 55%. The solution from the dissolver is then passed through line 29 to a wiped film dryer or evaporator, in which isopropanol and almost all of the water are removed, leaving a homogeneous mixture which, upon removal from the wiped film dryer (which normally operates at elevated temperature and under vacuum), turns solid. The homogeneous solid mixture is then transported to an amalgamator 33 where such mixture is blended with suitable adjuvants, such as titanium dioxide and perfume, after which it is delivered sequentially to mill 35, plodder 37, cutter 39 and press 41, all of which perform their normal functions, resulting in the production of a homogeneous monoglyceride sulfate detergent bar or cake which is of good foaming, lather, solubility, wear, slough, hardness, mildness, tactile and homogeneity characteristics, and which does not develop surface grittiness, even when employed to wash in cold water. Optionally, the material that is discharged from the dryer, which may leave it as a liquid (which may be at a temperature in the 60° to 90° C. range), will be solidified on a chill roll or similar "chipping" apparatus, and the chips resulting will be charged to the amalgamator.

DETAILED DESCRIPTION

In accordance with the invention a process for manufacturing monoglyceride sulfate detergent composition bars, of improved homogeneity and of lesser tendency for grittiness to develop on washing with them in cold water, comprises preparing a solution of water soluble higher fatty monoglyceride sulfate, water soluble higher fatty acid soap, and higher fatty acid, in a solvent, removing the solvent from the solution, recovering the monogeneous solid composition resulting, and extruding such composition in bar form. Also considered to be within the invention are the products of such process and products of like composition and properties. In a preferred embodiment of the process aspect of the invention the solution of the monoglyceride sulfate, soap and higher fatty acid is made by utilizing as a solvent an extractant medium (such as aqueous isopropanel) in which the neutralized monoglyceride sulfate was separated from sodium sulfate, present with it after manufacture due to neutralization of excess sulfuric acid, and the monoglyceride sulfate, soap (kettle soap is preferred), and free fatty acids are dissolved in such extractant, following which the solution is dried, using a wiped film dryer or evaporator, and the homogeneous dried mix, with detergent bar adjuvants further mixed therewith, if desired, is processed to bar and cake forms.

The monoglyceride sulfate, which is the primary detergent of the present detergent bars, is a water soluble detergent, such as an alkali metal salt of a higher fatty monoglyceride sulfuric acid. Although on occasion some potassium detergent, e.g., up to 25% of the monoglyceride sulfate detergent content, may be present, usually it will be preferred for such detergent to be the sodium salt. The higher fatty acyl of the monoglyceride sulfate will be of 10 to 20 carbon atoms and preferably will be of 12 to 18 carbon atoms, which means that the various mixtures of higher fatty acyls present will average in such ranges, preferably being essentially (over 90%) within such ranges. The higher fatty acyls of such monoglyceride sulfates will normally be saturated because during the sulfation reactions, which are usually conducted in strongly acidic media, unsaturated bonds are liable to react with sulfating agent and the acyls may split at such bonds. However, using milder conditions (or by other manufacturing steps) it may be possible to produce monoglyceride sulfates in which the fatty acyl moiety is unsaturated, and such components of the present bars will sometimes have especially desirable characteristics in such products and may be employed therein, but usually as only a portion of the monoglyceride sulfate content, e.g., up to 40% thereof.

Although it is possible to synthesize fatty acids and make the monoglyceride sulfate detergent from such a "synthetic" source of fatty acyl it is usually highly preferred to manufacture the monoglyceride sulfate from vegetable and/or animal oil(s) and/or fat(s), which are preferably saturated or essentially saturated. Such materials may be hydrogenated to minimize the presence of unsaturation and to facilitate production of the desired monoglyceride sulfate, without fatty acyl degradation. A preferred process for manufacturing the monoglyceride sulfate includes reaction of glycerol and excess oleum at elevated temperature (35° C.) to produce glycerol trisulfuric acid and excess sulfuric acid), followed by transesterification of two moles of the glycerol trisulfuric acid with one mole of triglyceride (fat and/or oil, preferably hydrogenated) at about 50° C. to produce three moles of acid mix, or

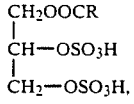

plus sulfuric acid, and subsequent neutralization of three moles of such monoesterified glycerol disulfuric acid with nine moles of sodium hydroxide at about 40° C. to produce three moles of the desired sodium monoglyceride sulfate and three moles of sodium sulfate. The monoglyceride sulfate is then solvent extracted from the sodium sulfate, preferably using an aqueous lower alcoholic extractant, preferably aqueous isopropanol.

Commercially the most desirable "pure" monoglyceride sulfate is H-coco monoglyceride sulfate because the products of this invention that are based on such detergent have the best balance of desirable characteristics (good lathering and an acceptable slough rate). However, other detergents which are useful are the corresponding coco, H-tallow, tallow, palm, H-palm, palm kernel, H-palm kernel and other vegetable and/or animal fats and/or oils and various mixtures thereof, preferably hydrogenated. An especially good such mixture is one wherein the monoglyceride sulfate is a mixture of sodium coco monoglyceride sulfate and sodium palm monoglyceride sulfate, usually with the proportions thereof in the 4:1 to 1:2 range, preferably 1:1, and more preferably with both being hydrogenated. Such more preferred product has been found to be of improved (lesser) slough characteristics and to be of very good forming properties, which might not have been expected in view of its content of palm monoglyceride sulfate (or the H- analog). Blends of coco and H-coco monoglyceride sulfate may be employed, and particularly desirable for some applications are blends of tallow and coco, H-tallow and H-coco, tallow and H-coco, and H-tallow and coco monoglyceride sulfates, preferably with low:high molecular weight ratios being in the ranges previously given for coco:palm detergents. In such blends the detergent containing higher acyls (from tallow and/or palm oil, either hydrogenated or not) improves the durability of the bar during use and decreases sloughing and gelling, whereas the detergent containing lower acyls (from coconut and/or palm kernel oils) improves foaming and lathering. Thus, such combinations of detergents can improve the overall performance of the inverted products.

Various other detergents may be present in the invented bars in supplementation of the monoglyceride sulfates, such as other sulfated and sulfonated lipophiles, usually having higher alkyl or acyl moieties present, such as the anionic detergents known as sulfated and/or sulfonated detergents. Among these are higher fatty alcohol sulfates or alkyl sulfates, olefin sulfonates, paraffin sulfonates, higher alkylbenzene sulfonates, higher fatty alcohol polyethoxy sulfates, isethionates and taurides, but preferably such supplemental detergents will be omitted or will amount to less than 25% of the total detergent content (total detergent basis) of the invented bars.

The higher fatty acid soaps may be made from the vegetable and/or animal oils and/or fats previously mentioned with respect to the monoglyceride sulfates manufacturings, and from mixtures thereof, or from fatty acids derived from such materials. The soaps will normally be alkali metal soaps, very preferably sodium soaps, but up to 25% of the total soap content (total soap basis) may be potassium or other water soluble soap that is compatible with the final product formulation and does not significantly adversely affect the useful characteristics thereof (and preferably noticeably improves some of them). Such higher fatty acid soaps will normally be of 10 to 20 carbon atoms in the fatty acyl moiety or moieties thereof, preferably of 12 to 18 carbon atoms in such fatty acyl group(s), and often the oils, and/or fats, or mixtures thereof, or the corresponding fatty acid mixtures will be hydrogenated, either prior to or after mixing. To obtain the most desirable properties for the final detergent bar it will usually be preferred for the soap to include some unsaturation, e.g. (up to 10% of the soap content being monounsaturated) which, it has been discovered, improves plasticity and processing characteristics, and thereby aids in producing a homogeneous detergent bar. In a highly preferred soap mixture, which includes mixed sodium tallow and coco soaps, neither of the soaps will have been made from a stock that was previously hydrogenated, and the proportion of tallow soap will be a major proportion whereas the proportion of coco soap will be minor. The ratio of tallow soap to coco soap will normally be within the range of 3:1 to 9:1 ,preferably 4:1 to 7:1, and more preferably 5:1 to 6:1, e.g., about 85:15.

The higher fatty acid(s) employed in making the detergent bars of this invention are higher fatty acids of the types described above or derivable by hydrolysis from the various vegetable and/or animal oils and/or fats or hydrogenated derivatives thereof described above (with respect to the monoglyceride sulfate and soaps). Very preferably, at least a portion of such fatty acid component will be stearic acid, the $C_{18}$ saturated fatty acid obtainable from tallow. However, it is within the scope of the invention to employ other higher fatty acid mixtures of 10 to 20 or 12 to 18 carbon atoms, including saturated acids such as lauric, myristic and palmitic acids, and unsaturated fatty acids such as oleic acid. Still, the saturated fatty acids are preferred and most preferred among these are mixtures of stearic and palmitic acid in which the ratio of stearic acid to palmitic acid is in the range of 1:1 to 2:1, preferably being in the range of 1:1 to 1.3:1. Such a mixture, comprising about 45% of stearic and about 55% of palmitic acid, is available commercially under the designation "triple-pressed stearic acid".

In the invented detergent bars the proportions of monoglyceride sulfate, soap and higher fatty acid will normally be within the ranges of 35 to 65%, 8 to 25% and 15 to 40%, respectively, preferably 40 to 60%, 10 to 20% and 20 to 35%, respectively, and more preferably 45 to 55%, 12 to 18% and 22 to 28%, e.g., about 51% of monoglyceride sulfate, 15% of soaps and about 25% of fatty acids.

Other components of the present detergent bars may include various adjuvant materials to give the bars particular desired characteristics. Such adjuvants may include: foaming agents, such as lower alkanolamides, e.g., lauric myristic diethanolamide; colorants, such as pigments and dyes, e.g., titanium dioxide, chrome green, ultramarine blue, and Polar Brilliant Blue dye; fluorescent brighteners, such as aminostilbene brighteners; antioxidants, e.g., benzohydroxytoluene; binders, e.g., starches and modified starches; enzymes, e.g., protease; bodying agents, e.g., talc; bactericides, fungicides and perfume. It will normally not be either desirable or necessary to employ plasticizers, such as higher fatty alcohols, in view of the higher fatty acid contents o the present bars, and the presence of some water in them. The total proportion of adjuvants present in the finished detergent bars will be a minor one, normally being in the range of 1 to 7%, preferably being less than 5% and more preferably being less than 3%.

Also often present in the detergent bars are materials that accompany one or more of the primary constituents of such bars. Sodium monoglyceride sulfate detergent usually contains as impurities therein, due to the method of manufacture, some sodium sulfate and some lower other soluble organic material. Such organic material may include glycerol, free fatty acid and mono-, di- and tri-glycerides. Usually the content of sodium sulfate will be in the range of 2 to 10% and it is frequently in the range of 4 to 6%, e.g., about 5%, on a total bar basis, which is the basis for the percentages of other components also given here. The total of organic byproducts of the manufacture of the monoglyceride sulfate detergent will usually be in the range of 1 to 8%, and often is in the range of 3 to 5%, e.g., about 4%. Water will also normally accompany the monoglyceride sulfate detergent, which is preferably employed in the present processes dissolved in its aqueous solvent extractant medium, and the content thereof in the final detergent bar will normally be in the range of 0.2 to 5%, often in the range of 0.5 to 1.5 or 2%, e.g., about 1%. Sometimes it may be desirable to add water to the amalgamator mix to further improve plasticity thereof, and to increase homogeneity, but usually the total water content will be within a mentioned range. When titanium dioxide is employed as an adjuvant the percentage thereof utilized will generally be within the range of 0.3 to 3%, preferably 0.5 to 2%, e.g., about 1%, and the proportion of perfume, which is usually present, will normally be in the range of 0.4 to 3%, preferably 0.5 to 2%, e.g., about 1.5%.

In the invented process, which results in a monoglyceride sulfate - soap - fatty acid mixture of improved homogeneity, from which a homogeneous and non-gritty bar can be made, the monoglyceride sulfate, soap and higher fatty acid components are dissolved in a suitable solvent, which is then removed from the solution, leaving the essentially dry solids (with a small proportion of water also being present) in homogeneous form. Such prior solution and the homogeneous form of the solids mixture (or solid solution) create a product of different properties from the merely mixed components, which solids "mixture" of the invention is more readily processed to bar form and exhibits no grittiness, even when the bar is employed for hand washing in cold water (water at a temperature in the range of 5° to 25° C., e.g., 15° C.).

The key steps in the processing described are the dissolving of the soap, fatty acids and monoglyceride sulfate in the aqueous lower alkanol solvent system and the subsequent drying of such solution to remove the isopropanol and most of the water, in which drying a wiped film evaporator is employed. The solvent is normally an aqueous lower alkanol of 3 or 4 carbon atoms, included in which group are isopropanol, n-propanol, n-butanol, sec-butanol and iso-butanol. Mixtures of any two or more of such lower alkanols may also be employed. Sometimes ethanol can be used, at least as part of the alcohol component, but its lower boiling point makes it less desirable in the present process (because processing losses are greater and recovery is more difficult, etc.). The aqueous alcoholic solvent and solution temperatures will normally be in the range of 50° to 90° C., preferably 50° to 70° C. and sometimes they will be at or about the reflux temperature of the solvents. The drying of the solution in the film dryer will be at an elevated temperature, with such temperature (of the heat transfer surfaces of the dryer) being at least 80° C. often being in the range of 90° to 210° C., and preferably being in the range of 100° to 150° C. In such acceptable and preferred temperature ranges the components of the solution are not degraded and yet the dryer throughput rate is satisfactorily high. Vacuum may be employed to speed drying and it may be any suitable vacuum, such as a pressure in the range of 1 to 100 mm. of mercury, absolute, preferably 0.5 to 3 mm. Hg.

Although other solvents than the lower alkanols may be employed to make the homogeneous solution of this invention, from which homogeneous "chips" of detergent composition can be made, and although lower alcohols, such as isopropanol, and especially aqueous lower alcoholic solvent systems, such as water-isopropanol solvent systems, may be employed to dissolve solid monoglyceride sulfate, soap and fatty acid components of the invented bars, it is highly preferred to utilize the water and isopropanol or other lower alcohol in the aqueous alcoholic monoglyceride sulfate extract from the extractor, in which solvent the monoglyceride sulfate is already dissolved, as the common solvent for the soap and fatty acids, too. Ideally, the soap will be added to such extract solution as kettle soap, whereby it supplies its heat to the solution and increases the solvent action thereof on the fatty acids, which are usually added as a solid (although they may be pre-heated or pre-dissolved, as in alcohol, to promote dissolving in the final solvent system. Alternatively, such fatty acids may be emulsified or dissolved in the kettle soap and such emulsion or solution may then be admixed with the monoglyceride sulfate extract. Thus, the process of this invention saves two drying steps, dryings of the monoglyceride sulfate and the kettle soap, utilizes the heat of the kettle soap, and employs as a solvent for the three main bar components, the aqueous alcoholic solvent medium already present.

The fatty acids charged to the dissolver are, for the purposes of the present invention, considered to be pure, although it is recognized that they may sometimes contain trace amounts or small proportions of feedstock materials, such as triglycerides. The kettle soap employed is in liquid state and is at a temperature in the range of 60° to 90° C., often 65° to 85° C. It usually contains small proportions of impurities, such as sodium chloride, glycerol and unreacted or partially reacted feedstock materials, such as triglycerides. However, the relatively small proportions of such impurities in such materials do not significantly affect the described processes or the final product, and accordingly are considered to be irrelevant to the present invention and not to require detailed consideration in this specification. Incidentally, the term "kettle soap" refers to soap made by the standard kettle process wherein triglyceride is reacted with sodium hydroxide in brine and the resulting soap phase is separated from the aqueous salt solution phase. While it is preferred to employ such soap it should be understood that soaps made by other processes, such as by neutralization of fatty acid, ay also e used in the present invention and such are intended to be included within the terminology "kettle soap", if they are of similar constitution and are present with water in a single phase at elevated temperature. The "kettle soap" which is preferably employed in the invented processes will normally have a water content in the range of 25 to 35%, e.g., about 30%, and such water adds to the water in the monoglyceride sulfate extract to form the aqueous alcoholic solvent employed in the dissolver to dissolve the monoglyceride sulfate, soap and fatty acids.

The monoglyceride sulfate extract will normally contain some sodium sulfate and some unreacted and by-product ether soluble materials, including various glycerides, free fatty acids and glycerol. The monoglyceride sulfate content of the extract charged to the dissolver will normally be in the range of 80 to 90%, e.g., about 85%, with the proportions of sodium sulfate and ether solubles being in the ranges of 6 to 10% and 5 to 9%, e.g., 8% and 7%, respectively, on a solids basis. The proportion of isopropanol to water in the dissolver solution will normally be within the range of 2:1 to 1:2, and preferably is within the range of 3:2 to 2:3, e.g., about 3:4. The solids content of such solution will normally be within a range of 45 to 65%, preferably 50 to 60% and most preferably about 55 or 56%.

In the wiped-film (or wiped-surface) dryer (or equivalent equipment) the solution from the dissolver is very quickly dried to a very low moisture content, which is normally in the range of 0.2 to 5%, preferably 0.5 to 1.5% or 2%, e.g., about 1%. Such drying usually takes place within a few seconds, such as from 0.5 to 10 seconds, especially when elevated temperatures and vacuum are employed. Because of such quick drying individual components of the solution do not crystallize objectionably (which would adversely affect homogeneity) and the product resulting is also homogeneous, in the sense that the various components thereof are very intimately distributed throughout it. In fact, it has been discovered that the properties of the dried product and of the detergent bars made from it are significantly different in various respects from what would be expected from the components thereof, and such differences are attributed to the homogeneous distribution of the components throughout. Another advantage of the wiped film dryer is that because of the short residence time of the solution or the resulting product in locations of high temperatures, decomposition of heat sensitive materials, such as monoglyceride sulfate, is minimized. Various wiped film evaporators or dryers may be employed in the present drying operations, such as those sold under the trademark Turba-Film.

After discharge of the dried product from the wiped-film (or wiped-surface) dryer such product, which is usually in liquid state when discharged from the dryer, may be converted to solid chip form on a chillroll or may be otherwise solidified, and then may be mixed with suitable adjuvants in a soap amalgamator or other equivalent mixer. Such mixture is then plodded to bar form, preferably after milling in a conventional three-roll or five-roll soap mill (which may be of the Lehman type). The plodder bar is cut to lengths and is pressed in a standard soap press. During the plodding operation, which is preferably conducted in a twin barrel (upper and lower) vacuum plodder, equipped with refining screens and heated nozzle plate, the mechanical working of the mix usually maintains the temperature thereof in the range of 25° to 50° C , often 30° to 40° (measured at the outlet from the plodder), despite the employment of cooling water. Yet, despite such mechanical working and the presence of even higher temperatures at "hot spot" locations within the mass of the material being plodded, the fatty acids do not appear to liquefy or soften so much as to cause a breakdown of the mass being plodded. Instead, the mass remains homogeneous, apparently due to the intimate distribution of the fatty acid throughout. When a more conventional amalgamator mix, made of the same fatty acid, monoglyceride sulfate and soap, but resulting from charging dried powders of such materials to the amalgamator, is milled and plodded, fatty acid separation and poor plodding have been noted, resulting in poor processing and an unacceptable bar. Such unacceptable bars, in the extreme case, are excessively plastic due to the separation of liquefied fatty acids from the rest of the bar composition, at normal elevated processing temperatures. Such bars cannot be satisfactorily pressed and the pressing dies tend to become loaded with flashings and separated portions of the blanks, leading to markings of the pressed cakes. If the composition can be plodded and pressed to cake shape it is found that on washing with such bars in cold water the surfaces thereof will exhibit a specked or pimpled appearance and the bar will feel gritty to the touch, which characteristics make it unacceptable to discriminating consumers. Repeated millings of the composition before plodding can diminish the grittiness of such bars but such milling is costly and time-consuming and is found to be commercially disadvantageous. Also, perfume losses accompany repeated millings and it is possible that the milled chips will be of different hardnesses, due to uneven "drying" during milling, which could cause additional grittiness to develop.

The bars made are of good foaming and lather characteristics, are of desirable but not excessive solubility, do not wear too much during use, do not exhibit thick coverings of gel on the surfaces thereof, are satisfactorily hard, in the opinions of consumers and when tested by penetrometer, and are mild to the skin, by both in vivo (collagen) and in vitro testing. The bars feel good to the touch and when held in the hand feel much like soap, which is the standard for satisfactory tactile properties. Visual and microscopic observations of the bars, plus evaluations of the properties thereof, show them to be homogeneous much better in such respect than bars of the same formula made from the solid state components thereof, which are admixed in an amalgamator, followed by normal processing.

In variations of the described processes one may add soap, usually in the form of chips (rather than as kettle soap), and fatty acids to the monoglyceride sulfate extract. In such processes the soap formulation may also be changed, as to 75:25 tallow:coco sodium soap, for example. In addition to varying the soap, the composition of the monoglyceride sulfate may be changed. It has been found that when the monoglyceride sulfate is that of a mixture of tallow and coco or palm and coco monoglyceride sulfates, as the sodium salts, in a range of 1:2 to 2:1, preferably about 1:1, the bars made have further improved anti-sloughing and durability (slow use-up) properties and yet, they still lather satisfactorily. In another process variation flake sodium monoglyceride sulfate detergent and stearic acid are dissolved in kettle soap, the resulting melt is converted to chip form, and it is then further processed, as previously described herein. In yet another process variation the soap is made in situ by partially neutralizing a fatty acid charge and the mixture resulting is blended with monoglyceride sulfate, in solid or solution form, with appropriate subsequent treatment and processing. Some evidence has been accumulated indicating that such in situ bars are of lower sloughing characteristics than bars made by conventional amalgamating of powdered components, followed by plodding, etc. Preferably, the partial neutralization will be carried out in the presence of the formula proportions of monoglyceride sulfate and the neutralization will be of mixed fatty acids, so mixed soaps are produced. The bars made by this method are homogeneous and remain stable, when heated, a property sometimes not observed in control bars made from powdered components.

The following examples illustrate but do not limit the invention. Unless otherwise indicated, all parts and percentages in such examples, elsewhere in the specification and in the claims, are by weight and all temperatures are in °C.

EXAMPLE 1

Manufacture of Detergent Bar Base 176.5 Parts of extract from the aqueous isopropanol separation of sodium sulfate from "active ingredient" after sodium hydroxide neutralization of the product of transesterification of glyceryl trisulfuric acid with a triglyceride, 21.4 parts of 85:15 tallow:coco kettle soap and 25 parts of triple-pressed stearic acid (45% stearic acid and 55% palmitic acid) are admixed in a dissolver (mixer), as illustrated in FIG. 1, wherein the dissolver is designated by numeral 27. The aqueous isopropanol extract of monoglyceride sulfate is comprised of about 34% solids, 33% water and 33% isopropanol. Of the solids, about 8% are inorganic (essentially sodium sulfate) and about 7% are ether soluble (essentially glycerides, fatty acids and glycerol), the remaining 85% being sodium H-coco monoglyceride sulfate. The kettle soap is 70% solids, which includes small proportions of sodium chloride, glycerol (held in the soap), fatty acids and glycerides. The fatty acids are solids, as supplied. The extract and the fatty acids are at room temperature and the kettle soap is at about 70° or 75° C.

In the dissolver the mix is heated to about 60° C. and mixing is continued at that temperature until the solution becomes clear, which may take about ½ hour. The solution is then fed to a wiped-surface evaporator (or wiped-film dryer) operating at an absolute pressure of about 1.8 mm. Hg, in which the heat transfer surfaces, which are continually wiped so as to renew thin films of solution for drying, are at a temperature in the range of 60° to 70° C. In the Turba-Film evaporator employed in manufacturing tests the drying rate is about 500 kg./hr. of product, which is about 15% greater than the drying rate for the extract alone. Instead of employing the Turba-Film evaporator or other wiped surface dryer one may utilize dryers of the Mazzoni or Proctor & Schwartz types but it is considered that the product of the present processes is more homogeneous than those produced from the other dryers, and the working temperature is lower, which promotes maintaining desired stability of the monoglyceride sulfate and any other heat sensitive materials present. Thus, use of the wiped film dryer favors production of a more homogeneous dried product, of superior properties.

On exiting from the wiped film dryer the product is in molten state but is very easily solidified, and the solids resulting from air or contact surface cooling may be charged directly to an amalgamator for additions of adjuvants prior to processing to bar and cake form. In some circumstances it may be preferred to conduct the liquid product from the Turba-Film evaporator to a chill roll, wherein it is cooled and solidified to thin sheets and ribbons, which may be cut to chips, if desired. It has been found that such chips are more readily transportable by conventional materials handling equipment, such as screw or helix conveyors, than are control Products of identical formulations which are dry blended (rather than dissolved in aqueous isopropanol before wiped film drying), or are dried from an aqueous dispersion by conventional drying means (not of the wiped film type).

The product discharged from the wiped film dryer contains about 51% of H-coco monoglyceride sulfate, about 4% of sodium sulfate, about 4% of ether solubles (accompanying the monoglyceride sulfate), about 15% of soap, about 25% of mixed stearic and palmitic acids, and about 1% of moisture, all in homogeneous solid form. Such homogeneous product is referred to as detergent bar base.

EXAMPLE 2

Final Detergent Composition Bar

| Component | Percent |
|---|---|
| Detergent bar base (from Example 1) | 97.5 |
| Titanium dioxide (pigment) | 1.0 |
| Perfume | 1.5 |
| | 100.0 |

The constituents of the above formula are mixed in a soap amalgamator and are milled in a three roll Lehman mill, plodded in a dual barrel vacuum plodder, cut to desired blank lengths and pressed in an automatic soap press to final desired cake form, using equipment described in the specification and drawing. Mixing in the amalgamator is conducted at about room temperature (21° C.) for about 10 minutes and milling is to a chip thickness of about 0.2 mm. Interior cooling water is used for the mill rolls and the ribbon or chip temperature leaving the mill is at about 35°-40° C. The milled ribbons resulting are fed to the vacuum plodder, wherein the composition temperature at the outlet is about 40° C.

The bars made are of an attractive white appearance, feel very much like soap when held in the hand, and are of pleasant fragrance. Foaming and lather tests on the bars made show that they foam satisfactorily and form an acceptably rich lather. The bars are not excessively soluble in water and do not wear away too quickly, so their consumption rate is acceptable. Although detergent bars tend to slough more than soap bars the sloughing of the present bars is less than that of most detergent bars. The bars made are satisfactorily hard, as verified by penetrometer testing, and are of superior mildness to human skin, as established by collagen test and by consumer reactions. The bars are homogeneous, as verified by microscopic examination, and they are not sticky, slimy or gritty, even after washing in cold water.

EXAMPLE 3

Alternative Detergent Bar

The procedures of Examples 1 and 2 are repeated except for replacement of the H-coco monoglyceride sulfate with a coco-tallow sodium monoglcyeride sulfate containing three parts of coco monoglyceride sulfate to one part of tallow monoglyceride sulfate. Preferably in both the coco and tallow monoglyceride sulfates the acyls will be hydrogenated so that the detergents will be saturated.

Bars resulting possess the same desirable characteristics as reported for the bars of Example 2 but sloughing with those of this example is even less, and satisfactory foaming and lathering are obtained. As with the composition of Example 2, processing is without difficulty despite the presence of fatty acids in the composition which can serve as plasticizers, especially at elevated temperatures. The bars made are homogenous and it is considered that many of the described improved properties are attributable to such condition.

EXAMPLE 4

Variations

Various other detergent bars within this invention are made by the same general processes, as are described in Examples 1-3, with variations in proportions of components ±10% and ±25%, within the limits set forth in the specification and with variations in the components themselves and the processing steps, as per the foregoing description. Products made are homogeneous and bars produced are satisfactory, according to laboratory tests and consumer acceptance evaluations.

In the bars of the preceding examples the various components are present in homogeneous relationship, despite significant differences in their chemical natures. The result is improved construction of the bars and their properties are also improved, and disadvantages of previous synthetic detergent bars attributable to the different and often conflicting properties of their components, such as soap, synthetic detergent and fatty acid, are avoided.

In the preceding description and in the claims the descriptions of various compositions and processes are preceded by "comprises", which leaves the claims open to the inclusion of other materials. However, some preferred embodiments of the invention "consist essentially" of the various steps and/or components, which leaves such descriptions and claims open to the inclusion of other components which do not significantly alter the inventive effect. Also contemplated as within the invention are detergent composition bars and manufacturing processes which consist of the described components and/or steps. Such descriptions and claims are narrow and close such claims except for the additions of relatively minor adjuvants and steps.

The invention has been described with respect to working examples, illustrations and embodiments thereof but it is not to be limited to these because it is evident that one of skill in the art, with the present specification before him, will be able to utilize substitutes and equivalents without departing from the invention.

What is claimed is:

1. A process for manufacturing sodium monoglyceride sulfate detergent composition bars of improved homogeneity and a reduced tendency for grittiness to develop on washing with then in cold water, which comprises preparing a solution of sodium $C_{12-18}$ fatty monoglyceride sulfate, sodium $C_{12-18}$ fatty acid soap and $C_{12-18}$ fatty acids in an aqueous lower alkanol solvent of 3–4 carbon atoms or any mixture of such alkanols, in water rapidly removing the solvent from the solution at a temperature of at least 80° C., mixing the resulting solid residual composition with adjuvants, plodding such mixture into bar form and stamping said bar into cake form.

2. A process according to claim 1 wherein $C_{3-4}$ alkanol and water are removed from a solution of sodium $C_{12-18}$ fatty monoglyceride sulfate, sodium $C_{12-18}$ fatty acid soap and $C_{12-18}$ fatty acids in alkanol and water by wiped film drying at a temperature of at least 80° C. for up to 10 seconds.

3. A process according to claim 2 wherein the sodium higher fatty monoglyceride sulfate is the sodium salt of monoglyceride sulfuric acid wherein the fatty monoglyceride moiety is of vegetable and/or animal oil(s) and/or fat(s), some or all of which may be hydrogenated, the soap is of mixed vegetable and/or animal oils and/or fats, some or all of which may be hydrogenated, the higher fatty acid is of mixed saturated higher fatty acids, the alcohol is isopropanol, n-propanol, n-butanol, sec-butanol or isobutanol, or a mixture of two or more thereof, and is aqueous, the drying of the solution is in a wiped film dryer at a temperature of at least 80° C. or from 0.5 to 10 seconds the mixing is effected in a soap amalgamator, the amalgamator mix includes the dried solution solids, finely divided pigment and perfume, the plodding is vacuum plodding at an outlet temperature in the range of 25° to 50° C., and the plodder bar is cut to cake size and stamped into cakes.

4. A process according to claim 3 wherein the proportions of sodium fatty monoglyceride sulfate, sodium fatty acid soap and fatty acid, in the sodium monoglyceride sulfate detergent composition bars, are in the ranges of 35 to 65%, 8 to 25% and 15 to 40%, respectively, the solution of sodium fatty monoglyceride sulfate, sodium soap and saturated fatty acids is in aqueous isopropanol, the proportion of isopropanol to water in such solution is within the range of 2:1 to 1:2, with the total proportion of monoglyceride sulfate, soap and free fatty acids in the solution being in the range of 45 to 65% and the solution temperature, prior to charging to the wiped film dryer being in the range of 50° to 90° C., the drying being effected in a wiped film dryer or wiped film evaporator, in which the temperature at heat transfer surfaces thereof is in the range of 90° to 210° C., the composition exiting from the wiped film dryer or evaporator contains 0.2 to 5% of water and essentially no isopropanol, the amalgamator mix is milled or refined so as better to disperse adjuvants throughout the composition thereof, and plodding is in a vacuum plodder.

5. A process according to claim 4 wherein the proportions of sodium fatty monoglyceride sulfate, sodium fatty acid soap and fatty acid in the monoglyceride sulfate detergent composition bars are in the ranges of 40 to 60%, 10 to 20% and 20 to 35%, respectively the solution of sodium fatty monoglyceride sulfate, sodium soap and saturated fatty acids in aqueous isopropanol is one wherein the proportion of isopropanol to water is within the range of 3:2 to 2:3, with the total proportion of monoglyceride sulfate, sodium soap and free saturated fatty acids in such solution being in the range of 50 to 60% and the solution temperature, prior to charging to the wiped film dryer or wiped film evaporator being in the range of 50° to 70° C., the temperature of the heat transfer surfaces of the wiped film dryer or evaporator is in the range of 100° to 150° C., and the composition exiting from the wiped film dryer or evaporator contains 0.5 to 2% of water.

6. A process according to claim 5 wherein the sodium fatty monoglyceride sulfate is sodium hydrogenated coco monoglyceride sulfate, the sodium fatty acid soap is a sodium tallow-coco soap 90 parts tallow soap and 10 to 20 parts coco soap, the acid consists of a mixture of stearic acid and acid, and the detergent composition bars comprise 45 of sodium hydrogenated coco monoglyceride sulfate, 12 to 18% of sodium tallow-coco soap wherein the ratio of tallow soap to coco is about 85:15, and 22 to 28% of triple-pressed, stearic which is of about 45%, stearic acid and about 55% palmitic acid, 4 to 6% of sodium sulfate, 3 to 5% of organic byproducts of the manufacture of the sodium hydrogenated coco monoglycer , 0.5 to 1.5% of water, 0.5 to 2% of perfume, 0 2% of titanium dioxide, and the balance, if any, of adjuvant(s) for synthetic detergent composition bars.

7. A process according claim 1 wherein the solution of water soluble sodium fatty monoglyceride sulfate, water soluble sodium fatty acid soap and fatty acid in the $C_{3-4}$ alkanol and water solvent is made by dissolving the soap and fatty acid in extracted neutralized fatty monoglyceride sulfuric acid, which is an aqueous $C_{3-4}$ alcoholic solution of the higher fatty monoglyceride sulfate at elevated temperature, whereby mutual solution of the mentioned components of the detergent composition bars is obtained in the $C_{3-4}$ solvent.

8. A process according to claim 4 wherein the solution of sodium fatty monoglyceride sulfate, sodium soap and saturated fatty acids in aqueous, isopropanol is made by dissolving the saturated fatty acids and kettle soap, which is at a temperature in the range of 60° to 90° C., in a solution of the sodium fatty monoglyceride sulfate in aqueous isopropanol extractant, in which extractant the proportion of isopropanol to water is within the range of 2:1 to 1:2, so that the total proportion of such monoglyceride sulfate, soap and free fatty acids) in the aqueous isopropanol is in the range of 45 to 65% and the solution temperature is in the range of 50° to 90° C.

9. A process according to claim 6 wherein the solution of sodium hydrogenated coconut monoglyceride sulfate, sodium tallow-coco soap, stearic acid and palmitic acid in aqueous isopropanol is made by dissolving the stearic and palmitic acids and sodium tallow-coco soap, in the form of kettle soap, at a temperature in the range of 65° to 85° C., in a solution of the sodium hydrogenated coco monoglyceride sulfate in aqueous isopropanol extractant, in which the proportion of isopropanol to water is within the range of 3:2 to 2:3, so that the total proportion of such sodium hydrogenated coco monoglyceride sulfate, sodium tallow-coco soap, stearic acid and palmitic acid in the aqueous isopropanol solvent is in the range of 50 to 60% and the solution temperature is in the range of 50° to 70° C.

10. A monoglyceride sulfate detergent composition bar of good foaming, lather, solubility, wear, slough, hardness, homogeneity and tactile characteristics which comprises sodium $C_{12-18}$ fatty monoglyceride sulfate, sodium $C_{12-18}$ fatty acid soap and $C_{12-18}$ fatty acid, and which is made by the process of claim 1.

11. A sodium fatty monoglyceride sulfate detergent composition bar of good foaming, lather, solubility, wear, slough, hardness, homogeneity and tactile characteristics which comprises sodium fatty monoglyceride sulfate wherein the monoglyceride moiety is of vegetable and/or animal oil(s) and/or fat(s), some or all of which may be hydrogenated, sodium soap of mixed vegetable and/or animal oils and/or fats, some or all of which may be hydrogenated, and mixed saturated higher fatty acids, derived from vegetable and/or animal oils and/or fats, some or all of which may be hydrogenated, which is a product of the process of claim 3.

12. A sodium monoglyceride sulfate detergent composition bar of good foaming, lather, solubility, wear, slough, hardness, homogeneity and tactile characteristics which comprises 40 to 60% of sodium fatty monoglyceride sulfate wherein the monoglyceride moiety is of vegetable and/or animal oil(s)and/or fat(s), some or all of which may be hydrogenated, 10 to 20% of sodium fatty acid soap wherein the fatty acid moiety is of fatty acids derivable from mixed vegetable and/or animal oils and/or fats, some or all of which may be hydrogenated and 20 to 35% of mixed saturated fatty acids of 12 to 18 carbon atoms, derivable from vegetable and/or animal oils and/or fats, some or all of which may be hydrogenated, made by the process of claim 4.

13. A sodium monoglyceride sulfate detergent composition bar of good foaming, lather, solubility, wear, slough, hardness, homogeneity and tactile characteristics which comprises 45 to 55% of sodium hydrogenated coco monoglyceride sulfate, 12 to 18% of sodium tallow-coco soap, wherein the ratio of tallow soap to coco soap is about 85:15, and 22 to 28% of triple-pressed stearic acid, which is of about 45% stearic acid and about 55% palmitic acid contents, 4 to 6% of sodium sulfate, 3 to 5% of organic byproducts of manufacture of sodium hydrogenated coco monoglyceride sulfate, 0.5 to 1.5% of water, 0.5 to 2% of perfume, 0.5 to 2% of titanium dioxide, and the balance, if any, of adjuvant(s) for synthetic detergent composition bars, which detergent composition bars are made by the process of claim 6.

14. A sodium monoglyceride sulfate detergent composition bar of good foaming, lather, solubility, wear, slough, hardness and tactile characteristics, in which the components thereof are homogeneously distributed throughout the bar so that a user of the bar will detect no surface grittiness of the bar on washing with it in cold water, which comprises 40 to 60% of sodium $C_{12-18}$ fatty monoglyceride sulfate wherein the monoglyceride moiety is of vegetable and/or animal oil(s) and/or fat(s), some or all of which may be hydrogenated, 10 to 20% of sodium $C_{12-18}$ fatty acid soap wherein the fatty acid moiety is of fatty acids derivable from mixed vegetable and/or animal oils and/or fats, some or all of which may be hydrogenated, and 20 to 35% of mixed saturated fatty acids of 12 to 18 carbon atoms, derived from vegetable and/or animal oils and/or fats, some or all of which may be hydrogenated.

15. A monoglyceride sulfate detergent composition bar according to claim 14 which comprises 45 to 55% of sodium hydrogenated coco monoglyceride sulfate, 12 to 18% of sodium tallow-coco soap, wherein the ratio of tallow soap to coco soap is about 85:15, 22 to 28% of triple-pressed stearic acid, which contains about 45% stearic acid and about 55% of palmitic acid, 4 to 6% of sodium sulfate, 3 to 5% of organic byproducts of manufacture of sodium hydrogenated coco monoglyceride sulfate, 0.5 to 1.5% of water, 0. to 2% of perfume, 0.5 to 2% of titanium dioxide, and the balance, if any, of adjuvant(s) for synthetic detergent composition bars.

* * * * *